United States Patent [19]

Richardson

[11] 3,936,109

[45] Feb. 3, 1976

[54] PORTABLE PODIUM

[76] Inventor: Josephine M. Richardson, R.R. No. 5, Decatur, Ind. 46733

[22] Filed: Sept. 19, 1974

[21] Appl. No.: 507,393

[52] U.S. Cl. ..... 312/223; 312/231; 108/150

[51] Int. Cl.[2] ..... A47B 27/00; A47B 13/00

[58] Field of Search ..... 312/223, 231, 33; 108/23, 108/32, 150; 248/188.4

[56] References Cited

UNITED STATES PATENTS

| | | | |
|---|---|---|---|
| 968,449 | 8/1910 | Cogger | 108/32 |
| 1,046,247 | 12/1912 | Baerresen | 108/150 |
| 1,147,077 | 7/1915 | Collier | 312/231 |
| 1,265,516 | 5/1918 | Reck | 108/150 |
| 1,369,439 | 2/1921 | Johnson | 312/231 |
| 2,031,304 | 2/1936 | Eller | 108/23 |
| 2,963,332 | 12/1960 | Breuning | 312/231 |
| 3,368,858 | 2/1968 | Motter et al. | 108/150 |
| 3,382,020 | 5/1968 | Meri | 312/223 |
| 3,467,033 | 9/1969 | Sienkiewicz et al. | 108/150 |

*Primary Examiner*—Casmir A. Nunberg

*Assistant Examiner*—Victor N. Sakran

*Attorney, Agent, or Firm*—Albert L. Jeffers; Roger M. Rickert

[57] ABSTRACT

A compact podium structure which is readily portable and which can also be supported at adjustable heights. The podium has a box-like upper part with an inclined, hinged upper wall, or lid, and includes a pedestal which is adjustable in length and which can be detachably connected to the botton of the upper part in about the center. The hinged lid of the upper part permits storage inside the podium upper part of the pedestal structure, as well as the speaker's notes, and the like. A lamp is provided which is detachably and adjustably connected to the top wall of the upper part, and this item can also be stored inside the upper part for transport. Still further, the hinged top wall of the upper part of the podium may include holes therethrough in one region and within the upper part of the podium a tape recorder can be provided for being supported beneath the holes in the top wall if so desired. The tape recorder, also, can be accommodated within the upper part of the podium.

5 Claims, 5 Drawing Figures

PORTABLE PODIUM

The present invention relates to a portable and adjustable podium for speakers and lecturers.

Portable podiums and the like are known but, heretofore, all have been lacking in certain respects with regard to convenience of transport and setting up and with regard to adjustability to accommodate different circumstances.

The principal object of the present invention is the provision of a portable podium structure which overcomes the defects that have been encountered with constructions according to the prior art.

Another object of the present invention is the provision of a relatively light weight readily portable podium structure which can be supported at adjustable heighths for greater convenience.

A further object is a portable podium structure comprising a box-like upper part having a hinged lid, or top wall, and having detachable components which are adapted to be stored within the box-like upper part of the podium.

BRIEF SUMMARY OF THE INVENTION

The podium according to the present invention comprises a box-like upper part which may, for example, be about 18 inches wide and 13 inches from front to back and may be about 8½ inches high at the back and 5 inches high at the front. The inclined top wall of the upper part of the podium is hinged thereto at the upper edge and the size of the box-like upper part permits accommodation therein of a detachable light for the podium, the speaker's notes and papers and other equipment and a tape recorder, if desired, as well as an adjustable pedestal adapted for connection to the underside of the box-like upper part in about the center.

The pedestal can be simply constructed from several pipe sections which can be connected by couplings with mounting flanges provided for the pipe sections on the bottom of the box-like structure and on the top of a flat supporting base member. By using several pipe sections for the pedestal post, one or more sections of the pipe can be employed so that the podium upper part can be supported on the floor or on a low table or on a higher desk or table, as might be required.

A detachable lamp is provided to illuminate the surface of the inclined top wall of the podium upper part for the benefit of the speaker and the inclined lid is also provided with holes in one region so that, if desired, a tape recorder can be placed inside the box-like upper part for recording the speech or lecture.

The top wall, or lid, of the box-like part, when hinged upwardly, exposes the inside of the box-like upper part and all of the components referred to above can be stored therein. A carrying handle connected to one side of the box-like upper part provides for ready portability of the podium structure when it is knocked down.

The exact nature of the present invention will become more apparent upon reference to the following detailed specification taken in connection with the accompanying drawings in which.

DETAILED DESCRIPTION OF THE INVENTION

Figure 1:
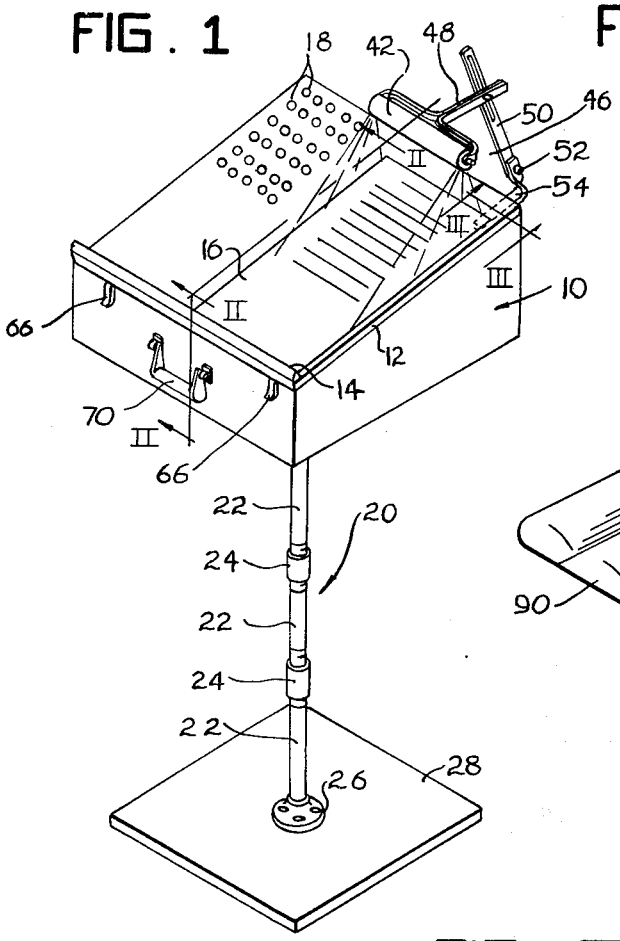
FIG. 1 is a perspective view showing the podium of the present invention in erected position.

Referring to the drawings somewhat more in detail, the podium according to the present invention is illustrated in FIG. 1 in erected position.

The podium of the present invention comprises an upper box-like part 10 which is about 18 inches in width from side to side and about 13 inches in the fore and aft direction. On the side toward the speaker, the box-like part may be about 5 inches high, and on the side facing away from the speaker, the box-like part may be about 8½ inches high.

This provides for the upper wall, or lid, 12 of the box-like upper part to incline upwardly in a direction away from the speaker and which is, of course, a convenience for reading notes and the like. At the edge nearest the speaker, top wall 12 may comprise a stop rail 14 for holding notes such as might be printed on the sheet of paper indicated in dot-dash lines at 16. Rail 14 may, if desired, be detachable from the top wall 12.

One region of the top wall 12, as toward the left side in FIG. 1, is provided with a plurality of apertures such as drilled holes 18, and these holes 18 are provided to permit sound readily to pass through the lid to be picked up by a tape recorder contained within the box-like upper part of the podium.

The podium comprises a pedestal generally indicated at 20 and which may consist of a plurality of threaded pipe sections 22 interconnected by threaded couplings 24, with the lowermost section 22 being threaded into a mounting flange 26 fixed to the upper side of a base member 28. The base member in fore and aft and lateral dimensions is of such a size that it is receivable within box-like upper part 10 of the podium structure.

Figure 2:
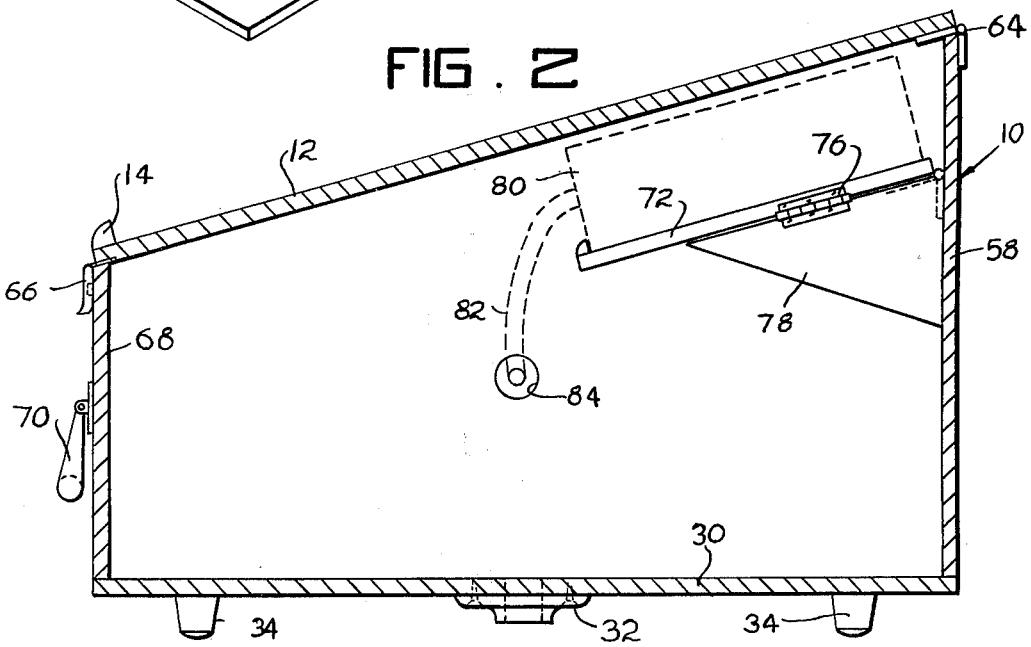
FIG. 2 is a transverse section indicated by cutting plane II—II—II on FIG. 1.

As will be seen in FIG. 2, the box-like upper part 10 has a bottom wall 30 and connected thereto is a further threaded mounting flange 32 into which the upper end of the uppermost pipe section 22 is threadedly receivable. Since flange 32 depends below the bottom wall 30 of the box-like upper part 10, the upper part 10 is advantageously provided with cushion tipped legs 34 so that the structure can be placed on a flat surface while holding flange 32 spaced from the surface.

Figure 5:
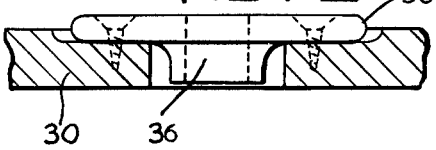
FIG. 5 is a fragmentary view showing a modification.

As will be seen in FIG. 5, a flange 36 corresponding to flange 32 could be mounted in a recess 38 formed on the inside of bottom wall 30 so that the flange would not protrude through the bottom wall and in which case the tipped legs on the bottom wall 30 could be substantially shorter.

A lamp structure, generally indicated at 40, is provided for illuminating the upper surface of inclined top wall 12. The lamp structure comprises a shield 42 within which a lamp bulb is mounted, which lamp bulb is supplied by the electrical connecting wire 44 with a switch 46 being provided in the lamp structure. The shield 42 is connected to a support bracket 48 which is adjustable vertically along slotted arm 50 in which slotted arm 50 is pivotally connected at 52 to a tongue member 54.

Figure 3:
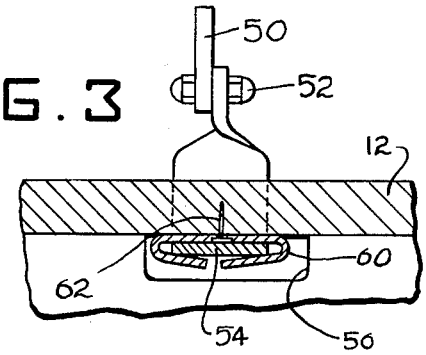
FIG. 3 is a fragmentary section indicated by line III—III on FIG. 1.

As will be seen in FIG. 3, tongue member 54 is adapted for insertion through a notch 56 formed in back wall 58 of box-like upper part 10 and into a groove provided by a metal strip 60 mounted on the underside of top wall 12 and having the side edges folded inwardly to provide a groove-like channel for receiving tongue 54. Metal strip 60 is secured to top wall 12 in any suitable manner as by nails or screw 62. The strip could, of course, be mounted on top of the top wall, or on a side wall of upper part 10, if so desired.

The top wall 12 is connected to back wall 58 of box-like upper part 10 as by hinge means 64 so that it can be tilted upwardly to expose the interior of the box-like upper part 10.

At the edge nearest the speaker, the top wall is adapted for being secured in closed position as by cooperating elements of clasp means 66 mounted on the top wall and the adjacent end wall 68 and which clasp means may be of substantially conventional nature. The wall 68 on the speaker's side of the box-like upper part 10 may also be availed of for supporting carrying handle 70 as shown in FIGS. 1 and 2.

Inside box-like upper part 10, and within the range of the apertures 18 in top wall 12 there is provided a shelf element 72 hinged to back wall 58 of upper part 10, as by hinge means 74. Shelf means 72 also has hinged thereto, as by hinge means 76, a stop flap 78. When the stop flap 78 is swung upwardly, the shelf 72 will drop down substantially flat against back wall 58 and will not obstruct the inside of the box-like structure.

However, when the shelf 72 is moved up to its FIG. 2 position and the flap 78 is moved downwardly to engage back wall 58, then the shelf will support a tape recorder 80 closely below the apertures 18. The tape recorder, if it requires an external power supply, may have a cord 82 leading therefrom and passing through an aperture 84 in the side wall of the box-like structure.

Figure 4:
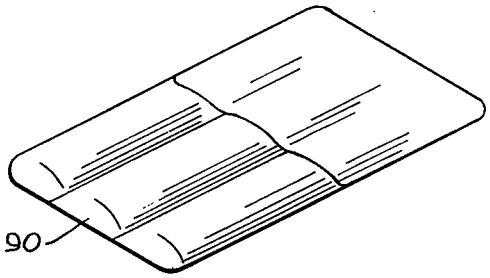
FIG. 4 is a perspective view showing a packaging case for the pipe section forming a part of the pedestal of the podium.

The pedestal portion of the podium structure, when knocked down, results in three pipe sections and for the purpose of safely and conveniently storing the pipe sections, there is provided a carrying case of plastic, or cloth, generally indicated at 90 in FIG. 4, and divided into pockets for receiving the pipe sections 22 together with couplings 24. This provides that the pipe sections will not be loose in the box-like structure which could lead to damaging the speaker's notes or other material, or articles contained therein.

Modifications may be made within the scope of the appended claims.

What is claimed is:

1. A podium structure comprising; a box-like upper part having bottom and side walls and also having a top wall which is inclined in the fore and aft direction, hinge means supporting one edge of the top wall on the side wall adjacent thereto for tilting of the wall to expose the inside of the said upper part, said top wall having an apertured region adjacent one side wall for transmission of sound to a recorder inside said upper part, a recorder support shelf pivotally connected to the back wall, said support shelf having a foldable stop flange connected thereto and adapted to engage the back wall for positioning the support shelf in position to receive the recorder, said support shelf and foldable stop flange adapted to be retracted to a closed position against the back wall of said upper part when not in use, and pedestal means for supporting said upper part adapted at the upper end for detachable connection to said bottom wall, said pedestal including a detachable base member at the lower end, said pedestal furthermore comprising axially adjustable means for varying the distance between said upper part of the podium and said base member.

2. A podium structure according to claim 1 including a lamp for illuminating the top of said top wall, an articulated linkage including a support tongue for supporting said lamp in operative position above said top wall, a tongue receiving member connected to said upper part of the podium and having an opening therein to slidably receive said support tongue.

3. A podium structure according to claim 1 in which said tongue receiving member is on the underneath side of said top wall near one edge of the top wall, and a notch in a said side wall adjacent said member providing an opening for access to said member by said tongue.

4. A podium structure according to claim 1 which includes cooperating elements of latch means on the edge of said top wall opposite the hingedly supported edge thereof and on the adjacent side wall to latch said top wall in closed position, and a carrying handle for transport of the podium on the same side side wall of the upper part.

5. A podium structure according to claim 1 in which the dimensions of said base member and axially adjustable means is such that when disassembled they can be disposed inside said upper part of the podium together with sundry other articles for transport of the podium structure.

* * * * *